United States Patent [19]

Daman et al.

[11] 4,137,037

[45] Jan. 30, 1979

[54] METHOD OF REPAIRING FURNACE ROOFS DURING HEAT-UP

[75] Inventors: Lloyd W. Daman, Pemberville; Don V. Marti, II; Michael L. Newsom, both of Toledo; Donald E. Shamp, Millbury, all of Ohio

[73] Assignee: Libbey-Owens-Ford Company, Toledo, Ohio

[21] Appl. No.: 839,805

[22] Filed: Oct. 6, 1977

[51] Int. Cl.[2] ..... F27D 1/16

[52] U.S. Cl. ..... 432/3; 110/335

[58] Field of Search ..... 432/3; 110/331, 334, 110/335

[56] References Cited

U.S. PATENT DOCUMENTS

| | | | |
|---|---|---|---|
| 1,032,960 | 7/1912 | Sugrue | 110/331 |
| 1,703,656 | 2/1929 | Betts | 110/331 |
| 3,428,716 | 2/1969 | Hughes, Jr. et al. | 432/3 |
| 3,448,974 | 6/1969 | Sarraf | 432/3 |

*Primary Examiner*—John J. Camby

*Attorney, Agent, or Firm*—Collins, Oberlin & Darr

[57] ABSTRACT

A method for preventing the dropping of individual bricks from a sprung arch roof employed in a continuous tank-type glass melting furnace, the dropping of the bricks normally occurring during heat-up of the furnace. The slightly tapered bricks employed in constructing the roof are oriented with their long axis in the vertical direction and, as heating occurs and the structure differentially expands and the bricks dry out, some become sufficiently loose to drop from the roof into the tank of the furnace. In visually observing the interior surface of the roof during heat-up, it can be seen which bricks are settling and likely to drop therefrom. These bricks are pulled up through the roof from above by a suction cup and mortar is placed around the bricks. The bricks are then dropped back into place with the mortar holding the bricks until they become wedged firmly in place as the temperature of the roof increases.

3 Claims, 3 Drawing Figures

METHOD OF REPAIRING FURNACE ROOFS DURING HEAT-UP

BACKGROUND OF THE INVENTION

1. Field of the Invention

This invention relates to sprung arch roofs or crowns of continuous glass melting furnaces, and more particularly to the problems resulting from the non-uniform temperatures encountered during heat-up of the furnace which cause portions of the overall structure, as well as the individual bricks employed in constructing the arched refractory roofs, to expand at different times.

2. Description of the Prior Art

Conventionally, sprung arch roofs as employed in continuous glass melting furnaces spring from skews running the entire length of the furnace; the skews being set on heel plates firmly attached to the buckstays forming part of the furnace superstructure. Conventionally, the roof is built up of individual, tapered, like-sized refractory bricks which may be set in an overlapping pattern like the checker pattern of a conventional brick wall. An example of such a roof is shown in U.S. Pat. No. 2,236,920 issued on Apr. 1, 1941. The construction of such roof may be accomplished by simply dipping the individual bricks in a siliceous mortar and setting them in place on a form supported by scaffolding. When the form on which the roof has been laid during construction is removed, the slight elastic yielding of the buckstays and tie rods, together with the bedding-in of the contacting surfaces of adjacent bricks against each other, allows the crown of the roof to drop slightly and small gaps to open between the lower ends of the bricks. Thereafter, when the furnace is heated up, the bricks expand and raise the crown to its original position.

Newly constructed roofs as above-described are often very damp, and they are slowly dried out over a period of time (10 to 12 days), by temporary burners such as salamanders placed at convenient locations about the furnace. During this time, the temperature throughout the furnace and the roof will not be uniform. It is the usual practice in glass melting furnaces to construct the arches of silica bricks, which exhibit their maximum thermal expansion at low temperatures such as those encountered during the drying-out period. Accordingly, it may be found that the bricks expand at different times or the crown may warp during the drying-out period by rising unequally in one part or another with respect to the plane or symmetry of the tank. Consequently, as heating occurs and the bricks dry out, some may become sufficiently loose to drop from the roof arches into the interior of the furnace.

In the past, bricks dropping out of the roof have been replaced by driving larger, wedge-shaped bricks into the openings after the original bricks have fallen, with the new bricks being initially held in place due to their larger size, and then by their expansion as heat-up continues. This procedure is not entirely satisfactory in that it requires the insertion of a cold, larger size brick into an arch of the heated bricks, causing the pressure on the bricks to be increased as the heat-up continues since the ends of the arches are held in a fixed position by the skrew backs. As a result, the bricks may spall or be crushed and a section of the roof may fall. Another disadvantage is that it is necessary to retrieve the fallen bricks from the tank so that they will not contaminate the glass to be produced therein.

SUMMARY OF THE INVENTION

The above-mentioned disadvantages are overcome by the procedure of this invention which comprises the steps of visually inspecting the interior surface of the arches of the roof to see which bricks are settling and protruding from the interior surface, grasping the extending bricks from above by a suction cup; pulling the bricks back up through the roof; coating the bricks with mortar and dropping them back into their place in the roof; the mortar holding the bricks until they become firmly wedged in place as the temperature of the roof increases.

OBJECTS AND ADVANTAGES

An object of this invention is to provide a method for preventing the dropping of bricks from a sprung arch roof of a glass melting furnace during heat-up.

Other objects and advantages will become more apparent during the course of the following description, when taken in connection with the accompanying drawing.

BRIEF DESCRIPTION OF THE DRAWING

In the drawing, wherein like numerals are employed to designate like parts throughout the same.

DESCRIPTION OF THE PREFERRED EMBODIMENT

Figure 1:
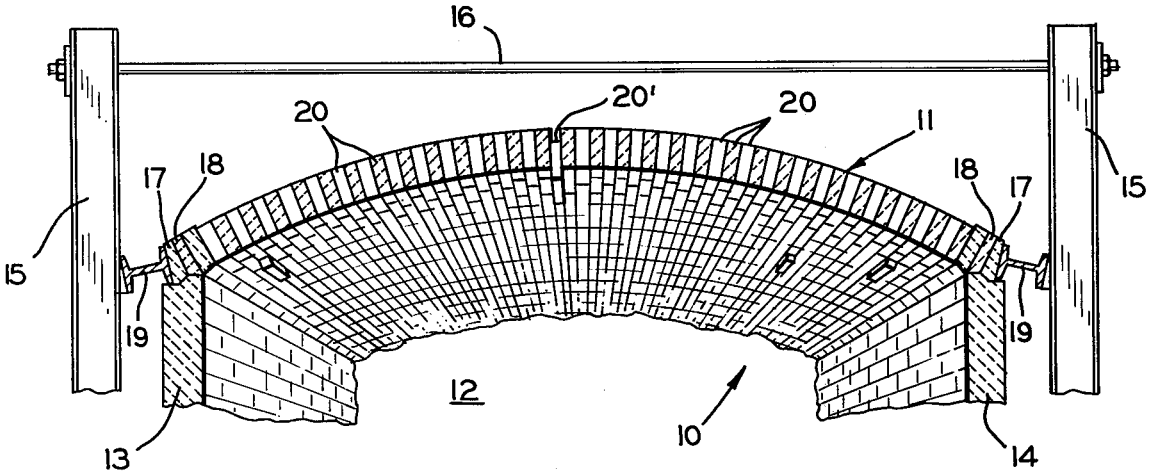
FIG. 1 is a transverse fragmentary perspective view, partly in section, showing a portion of the interior and illustrating bricks settling in the roof.

As illustrated in FIG. 1, only the upper portion of a glass melting furnace 10 is shown as the invention relates specifically to a sprung arch roof or crown 11 therefor. As therein illustrated, the melting furnace 10 includes a chamber 12 bounded by jamb walls 13 and 14, buttressed by buckstays 15 connected together by tie rods 16 for stabilizing the furnace structure.

Located on the top of each of the jamb walls 13 and 14 are skew blocks 17 and 18 which run the entire length of the chamber 12 and are suitably supported as upon longitudinally extending I-beams 19, for example, which are rigidly secured to the buckstays 15.

Figure 2:
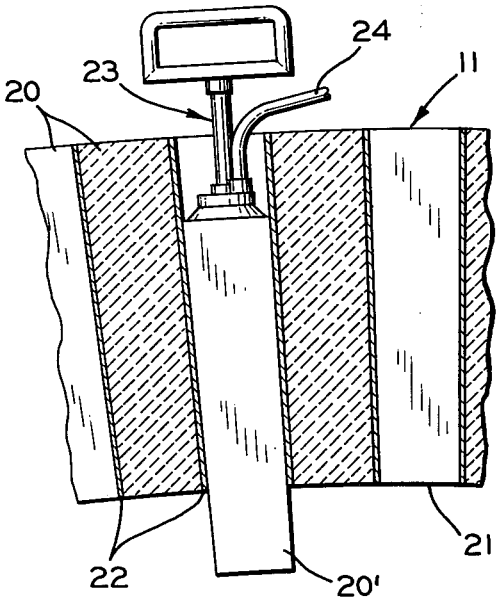
FIG. 2 is an enlarged, fragmentary, sectional view of one of the arches of the roof showing a brick settled from its normal position just prior to being removed from the arch.

Springing from the skew blocks 17 and 18 is the sprung arch roof 11 which is normally built up of a plurality of individual refractory bricks 20 measuring 18 inches (45.72 cm) in length, 9 inches (22.86 cm) in width and tapering from a thickness of 3 inches (7.62 cm) across the top to 2⅞ inches (6.30 cm) across the bottom. As is common practice, the bricks 20 are layed in overlapping courses 21 with their long axes oriented in a vertical direction with a heat setting mortar 22, one that sets at about 2000° F. (1093° C.), (see FIG. 2) between their joints. Accordingly, the roof 11 as a whole is composed of a series of these courses 21 interlocked together and becomes a monolithic structure after the mortar sets.

With the sprung roof 11 formed as just described, it will be obvious that as the furnace is initially heated and the drying out and heating up process proceeds, the individual bricks 20 in the roof will expand as they absorb heat, and that since they are set with a mortar that does not harden until it reaches a relatively high temperature, the bricks will be free to move relative to each other.

As previously indicated, the furnace is initially heated by temporary burners placed at various locations about the furnace, and thus the temperature throughout the furnace may not be uniform. Thus, the individual bricks 20 will absorb heat at different rates and expand accordingly. This differential absorption of heat by the bricks will loosen some to the point that they may settle and project through the interior surface of the roof 11.

Figure 3:
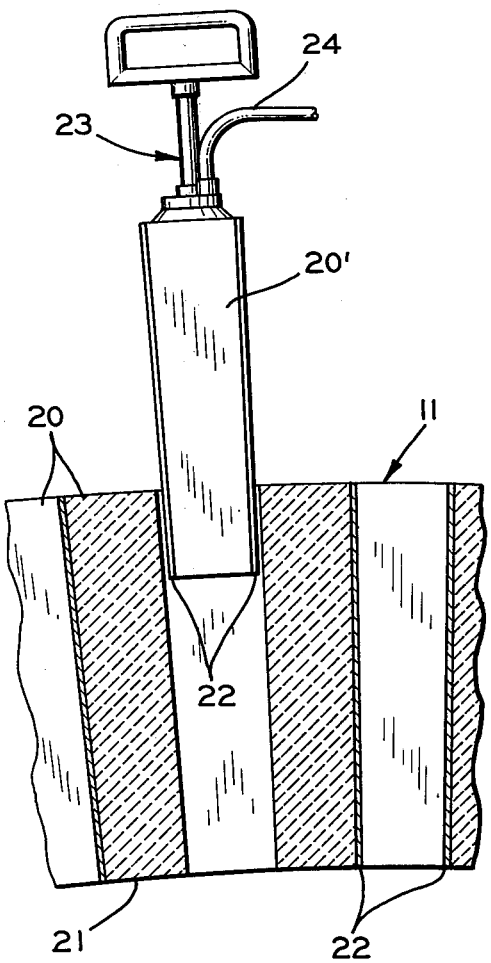
FIG. 3 is a view similar to FIG. 2 but showing a removed brick coated with mortar just prior to its being reset in the arch.

In accordance with the invention, the interior surface of the roof 11 is kept under visual surveillance and when an individual brick 20' is observed are absorbed to settle and project into the chamber 12, the top of the brick 20' is grasped by a suction device 23 (see FIGS. 2 and 3) connected to a source of vacuum pressure (not shown) by a hose 24. As indicated in FIG. 3, the brick 20' is lifted out of the roof 11, coated with additional mortar such as the heat setting mortar 22, and then pushed back into place in the roof. It has been found that this additional mortar will hold the brick until it becomes wedged firmly in place as the heat-up continues and the temperature of the roof increases.

It is to be understood that the form of the invention herewith shown and described is to be taken as an ilustrative embodiment only of the same and that various procedural changes may be resorted to without departing from the spirit of the invention.

We claim:

1. A method of preventing individual bricks from dropping from a sprung arch roof of a furnace during initial heat-up thereof comprising the steps of:

a. visually observing the interior surface of said sprung arch roof and detecting any individual bricks which change position and project below said surface;

b. grasping said individual brick projecting from the top and removing said brick from said roof;

c. applying mortar to the sides of said removed brick; and d. re-inserting said mortar coated brick in said roof.

2. A method of preventing individual bricks from dropping from a sprung arch roof as claimed in claim 1, wherein the top of said brick is grasped by a vacuum device.

3. A method of preventing individual bricks from dropping from a sprung arch roof as claimed in claim 1, wherein said mortar is a heat setting mortar which does not set until it reaches a temperature of about 2000° F. (1093° C.).

* * * * *

UNITED STATES PATENT AND TRADEMARK OFFICE

CERTIFICATE OF CORRECTION

PATENT NO. : 4,137,037

DATED : January 30, 1979

INVENTOR(S) : Lloyd W. Daman et al

It is certified that error appears in the above-identified patent and that said Letters Patent are hereby corrected as shown below:

Col. 1, line 64, "skrew" should be --skew--

Col. 3, line 17, cancel "are absorbed"

Signed and Sealed this

*First* Day of *May 1979*

[SEAL]

*Attest:*

RUTH C. MASON
*Attesting Officer*

DONALD W. BANNER
*Commissioner of Patents and Trademarks*